US005248210A

United States Patent [19]

Schulz

[11] Patent Number: 5,248,210

[45] Date of Patent: Sep. 28, 1993

[54] APPARATUS FOR THE TRANSPORTATION OF RECORD SHEETS IN AN INK-JET PRINTER

[75] Inventor: Harald Schulz, Berlin, Fed. Rep. of Germany

[73] Assignee: Siemens Aktiengesellschaft, Munich, Fed. Rep. of Germany

[21] Appl. No.: 752,538

[22] PCT Filed: Feb. 1, 1990

[86] PCT No.: PCT/DE90/00070

§ 371 Date: Aug. 30, 1991

§ 102(e) Date: Aug. 30, 1991

[87] PCT Pub. No.: WO90/09891

PCT Pub. Date: Sep. 7, 1990

[30] Foreign Application Priority Data

Mar. 3, 1989 [DE] Fed. Rep. of Germany ..... 3907329

[51] Int. Cl.[5] ..... B41J 13/03

[52] U.S. Cl. ..... 400/625; 400/629; 400/636; 400/635; 271/271; 271/315

[58] Field of Search ..... 400/625, 629, 635, 662, 400/636, 641; 271/233, 269, 271, 315, 204, 277

[56] References Cited

U.S. PATENT DOCUMENTS

| | | | |
|---|---|---|---|
| 4,207,579 | 6/1980 | Rogers et al. | 346/75 |
| 4,340,314 | 7/1982 | Berger | 400/625 |
| 4,431,323 | 2/1984 | Kulow | 400/625 |
| 4,540,298 | 9/1985 | Kulow | 400/635 |
| 4,604,851 | 8/1986 | Reist | 53/430 |
| 4,688,957 | 8/1987 | Prevignano | 400/605 |
| 4,764,043 | 8/1988 | Jaffe | 400/629 |
| 4,865,305 | 9/1989 | Momiyama et al. | 271/116 |
| 4,874,161 | 10/1989 | Murasaki et al. | 271/265 |

FOREIGN PATENT DOCUMENTS

| | | |
|---|---|---|
| 2005616 | 8/1971 | Fed. Rep. of Germany . |
| 3739235 | 5/1988 | Fed. Rep. of Germany . |
| 0660171 | 3/1987 | Switzerland . |

OTHER PUBLICATIONS

IBM Technical Disclosure Bulletin, vol. 6, No. 8, Jan. 1964, New York, US, p. 91, Eichorn: "Feeding Apparatus For Continuous and Cut Forms".

*Primary Examiner*—Edgar S. Burr
*Assistant Examiner*—Christopher A. Bennett
*Attorney, Agent, or Firm*—Kenyon & Kenyon

[57] ABSTRACT

A pair of conveyor rolls for transporting each record sheet to be printed past the ink-jet printing head is disposed directly below the printing zone of an ink-jet printing head to permit the transportation of freshly printed record sheets within an ink-jet printer without the print being smudged. A gripping device grabs the printed record sheet at its lower edge immediately after it has left the pair of conveyor rolls and carries it out of the printing zone and into an output area.

8 Claims, 2 Drawing Sheets

APPARATUS FOR THE TRANSPORTATION OF RECORD SHEETS IN AN INK-JET PRINTER

BACKGROUND OF THE INVENTION

A problem that occurs during ink-jet printing is that immediately after graphic information such as text, for example, has been printed on a record sheet, a certain period of time must pass before the graphic information just printed is sufficiently smudge-resistant so that the printed side of the record sheet can contact other objects without smudging the print. This is particularly true when a nonpenetrating ink is used. While in principle it is possible to decrease the drying time by using a heater and/or blower, such devices add to the cost of the printer and, because of their high power consumption, are not suitable for small battery-operated ink-jet printers. Hence, if supplemental drying aids are dispensed with, it is necessary to prevent the printed graphic information from contacting other objects while the record sheet that has just been printed is conveyed from the printing zone to an output area.

This task might be accomplished if conveyor rolls used to transport the record sheet were to make contact therewith only near the margins. However, given a sheet having a printing width of 8 inches, and allowing for tolerances, there would only remain available a few tenths of a millimeter at the edge of an A4 sheet that could be used for transportation. Otherwise, the available printing width would have to be reduced. Alternatively, if a pin feed were used to move the record sheet, smudging would be confined to individual points but would not be prevented altogether. Other possible methods for transporting the record sheet into the output area include: holding the back of the sheet by electrostatic forces or by a vacuum, as described in U.S. Pat. No. 4,207,579, for example; moving the sheet by conveying air; providing additional acceleration of the advancing sheet at the end of the printing process; or utilizing gravity to move the sheet to the output position. However, these methods either involve a considerable expenditure in terms of their construction and power consumption, or they do not reliably convey the print medium to the output area, especially when different weights of paper are used.

Thus, the problem with the prior art is that there is no apparatus for the transportation of record sheets in an ink-jet printer in which smudging of the printed graphic information is prevented, and which has a design and sufficiently low power consumption that makes it particularly suitable for small battery-operated ink-jet printers, and furthermore which reliably conveys the record sheets to an output area.

SUMMARY OF THE INVENTION

The present invention provides an apparatus for transporting record sheets to be printed in an ink-jet printer that includes a pair of conveyor rolls disposed below a printing zone of an ink-jet printing head. The conveyor rolls transport each of the record sheets to be printed past the ink-jet printing head. A gripping or transporting device grabs or pushes the printed record sheet at its lower edge after it has left the pair of conveyor rolls and conveys the printed record sheet from the printing zone to an output area.

Since the gripping device grabs the record sheet at its lower edge, there is no contact with the printed side of the record sheet, and hence smudging of the print is avoided even when the record sheet has been printed over its entire surface (i.e., the sheet has no margins). Moreover, the gripping device provides positive guidance of the record sheet from the printing zone into the output area, and therefore the printed record sheets are reliably deposited into the output area.

Whenever the printing of a record sheet is completed, the gripping device is activated by a form-feed signal so that it moves the record sheet into the output area. For this purpose, the gripping device may have a drive of its own which is activated by the form-feed signal. However, it is advantageous if the gripping device is adapted to be coupled to the pair of conveyor rolls by a clutch that is controlled by the form-feed signal. This configuration minimizes the expenditures in terms of construction and power consumption since the motion of the gripping device results from the movement of the pair of conveyor rolls and thus only one drive is needed for both the conveyor roll pair and the gripping device.

The gripping device may be implemented in several ways. For example, link mechanisms which upwardly move the printed record sheet from the printing zone to the output may act with one slewing motion or with several motions. In one embodiment of the invention, the gripping device includes at least one belt that passes over two end rolls and which has an external grabbing hook. This gripping device, which resembles a belt conveyor, has a minimum of parts and permits the transportation of the record sheet over the distance between the two end rolls, one of which, the lower end roll, is located in proximity to the printing zone of the ink-jet printer while the other, the upper end roll, is located in proximity to the output area. The upper end roll may be advantageously positioned higher than the output area, which is located directly downstream of the upper end roll relative to the rotational direction of the upper end roll. Consequently, the printed record sheet is lifted by the grabbing hook over the upper end roll and dropped into the output area, which is located below the upper end roll so that the sheet is unable to fall out of the output area.

In view of the above-mentioned rotational coupling of the gripping device to the pair of conveyor rolls, the lower of the two end rolls is preferably positioned loosely on the shaft of one of the conveyor rolls of the conveyor-roll pair, and the clutch is a driving clutch. Thus, a particularly space-saving arrangement of the lower end roll together with the clutch and the conveyor-roll pair is achieved, which makes the apparatus of the invention compact.

To obtain a precise alignment of the record sheet to be printed relative to the ink-jet printing head in proximity to the printing zone, an advantageous feature of the invention includes the provision of a support surface in the printing zone for supporting the record sheets to be printed, and for the one or more belts to extend in a groove-like recess that is within the support surface over a portion of their run.

DETAILED DESCRIPTION

Figure 1:
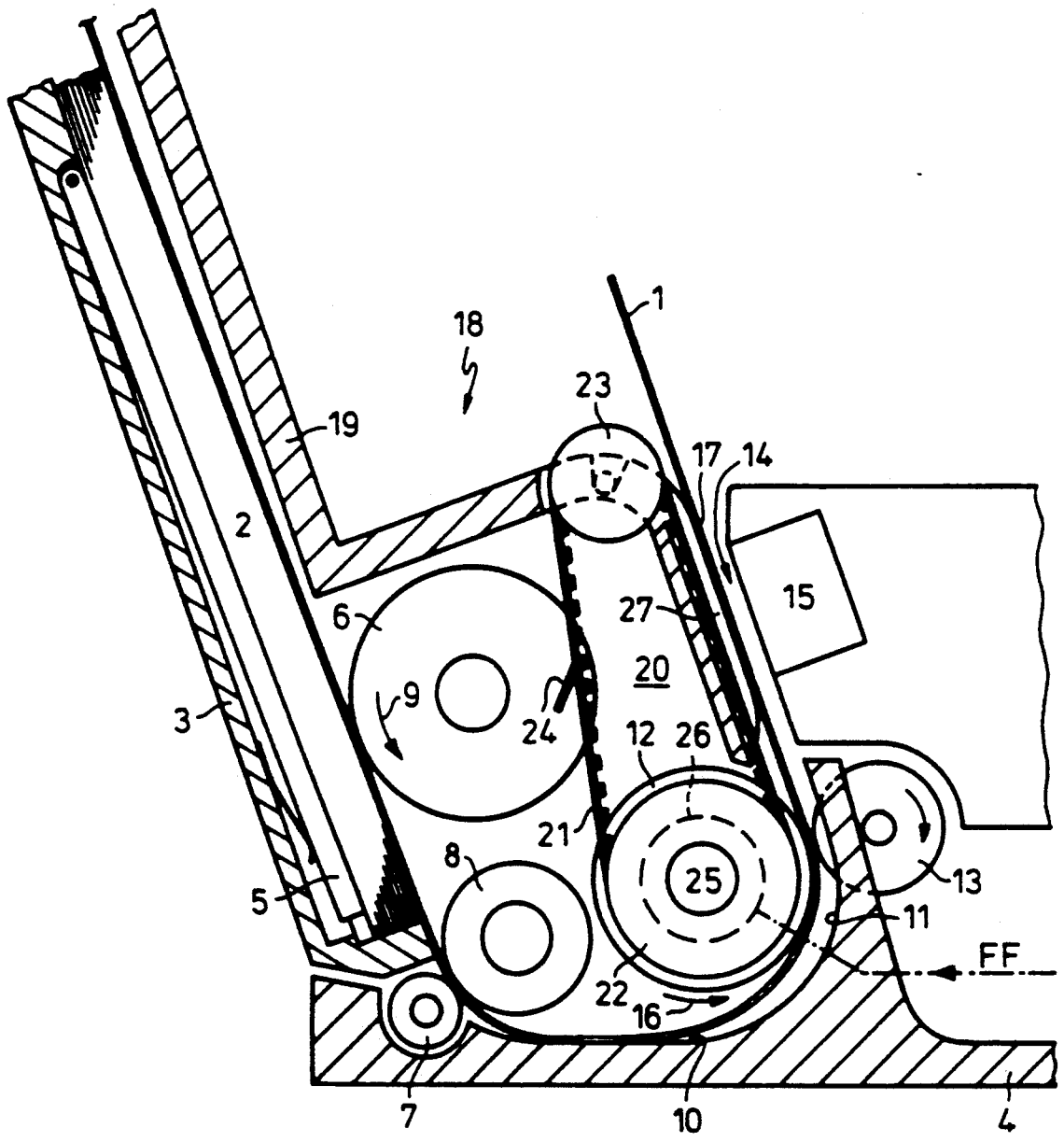
FIGS. 1 and 2 each show, in differing operational states, a partial, cross-sectional view of an ink-jet printer illustrating the apparatus for transporting record sheets constructed according to the principles of the invention.

Record sheets 1 to be individually printed are maintained in a stack 2 within a supply cassette 3. The supply cassette 3 is in an inclined position and is inserted in a housing part 4 of the ink-jet printer, of which only a portion is visible in the Figures. The stack 2 of sheets is pressed against a sheet-feeder roll 6 by a support plate 5 that is disposed in a spring-loaded manner at the bottom of the supply cassette 3. The sheet-feeder roll 6 serves to pull the record sheet 1 that is at the top of the stack 2 and feed it between two adjacent rolls 7 and 8 located below the supply cassette 3. The sheet-feeder roll 6 pulls the sheet I in the direction of rotation 9 of the sheet-feeder roll 6. The rolls 7 and 8 deflect the record sheet 1 into a guide trough 10 formed in the bottom of the housing part 4, which guides the record sheet 1 upward through a baffle element 11 and into the draw-in nip formed between a pair of conveyor rolls 12 and 13. The conveyor-roll pair 12 and 13 is located directly below the printing zone 14 of an ink-jet printing head 15 and serves to convey the record sheet 1 at a given line-feed speed upward through the printing zone 14 and past the ink-jet printing head 15 while the record sheet 1 is being printed by the printing head 15. To accomplish this task, the pair of conveyor rolls 12 and 13 is driven by a drive (not shown in the Figures) at a constant rotational speed in the direction of rotation indicated by arrow 16. In the printing zone 14, the record sheet 1 to be printed lies squarely on a support surface 17 at a given distance from the ink-jet printing head 15 so that uniform printing occurs on the record sheet 1.

After the record sheet 1 has been printed, it needs to be conveyed to an output area 18 in an output bin 19. This is accomplished by a gripping or transporting device 20 formed by two drive belts which in the direction perpendicular to the cross-sectional plane visible in the Figures are spaced apart by a distance that is less than the width of the record sheet 1. Only the front drive belt 21 is visible in the Figures. The gripping device 20 includes the belt 21, which passes over two end rolls 22 and 23, and an external protuberance in the form of a grabbing hook 24. The lower end roll 22 is positioned loosely on the shaft 25 of the conveyor roll 12 and can be coupled, via a controllable drive clutch 26 (indicated in the Figures by a dashed line) to the drive for the conveyor roll 12 as a function of a form-feed signal FF. In order not to interfere with the contact between the record sheet 1 and the support surface 17, the belt 21 runs in a groove-like recess 27 in the support surface 17 over the portion of its extent between the two end rolls 22 and 23. The upper end roll 23 is raised relative to the output area 1 18 in the output bin 19, which is located directly downstream of the end roll 23, relative to the rotational direction of roll 23.

As is apparent from FIG. 1, the sheet-feeder roll 6 is driven to pull a record sheet 1 to be printed off the sheet stack 2, convey it between the rolls 7 and 8 to the guide trough 10 and the baffle element 11, and finally convey it into the draw-in nip formed between the pair of conveyor rolls 12 and 13. The conveyor rolls 12 and 13 transport the record sheet 1 at a given line-feed speed past the ink-jet printing head 15 as it is being printed. During this process, the lower end roll 22 is not coupled to the conveyor roll 12, and hence the gripping device 20 is not actuated.

Figure 2:
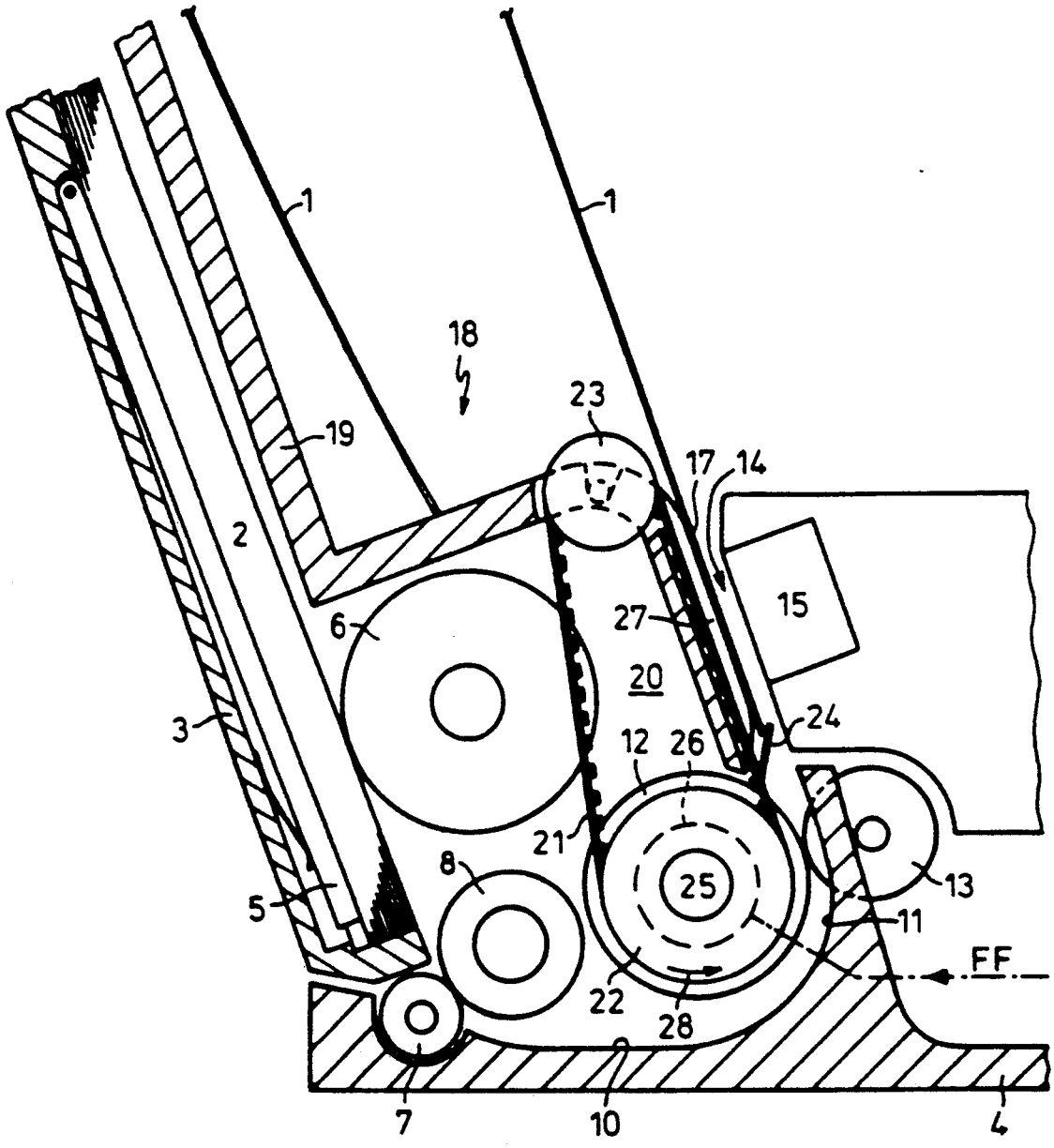

Upon completion of the printing process, as the lower edge of the record sheet 1 leaves the conveyor-roll pair 12 and 13, the lower end roll 22 is coupled to the conveyor roll 12 by means of the driving clutch 26, which is engaged by the form-feed signal FF, as shown in FIG. 2. Consequently, the belt 21 is driven and, with its grabbing hook 24, it grabs or pushes the printed record sheet 1 at its lower edge and carries the sheet 1 out of the printing zone 14 without touching the printed matter. The record sheet 1 is then carried over the upper end roll 23, where it drops into the output area 18 in the output bin 19.

I claim:

1. An apparatus for transporting record sheets to be printed in a compact ink-jet printer, said apparatus comprising:

a pair of conveyor rolls disposed entirely below a printing zone of an ink-jet printing head transporting each of the record sheets to be printed past the ink-jet printing head;

a transporting device for pushing the printed record sheet at only a lower edge thereof after said lower edge has left said pair of conveyor rolls and for conveying the printed record sheet from the printing zone to an output area; and a clutch for selectively coupling said transporting device to at least one of said pair of conveyor rolls upon receiving a form-feed signal.

2. The apparatus of claim 1 wherein said transporting device includes upper and lower end rolls and at least one belt passing over said end rolls, said belt having an external protuberance.

3. The apparatus of claim 2 wherein said upper end roll is disposed at a vertical height greater than said output area, and said output area being located downstream of said upper end roll relative to a rotational direction of said upper end roll.

4. The apparatus of claim 2 wherein said lower end roll is loosely mounted on a shaft of one of the conveyor rolls of said conveyor-roll pair.

5. The apparatus of claim 3 wherein said lower end roll is loosely mounted on a shaft of one of the conveyor rolls of said conveyor-roll pair.

6. The apparatus of claim 2 further comprising a support surface disposed in the printing zone for supporting the record sheets to be printed, said support surface having a grooved recess and said at least one belt extending in the grooved recess over a portion of its run.

7. The apparatus of claim 3 further comprising a support surface disposed in the printing zone for supporting the record sheets to be printed, said support surface having a grooved recess and said at least one belt extending in the grooved recess over a portion of its run.

8. The apparatus of claim 4 further comprising a support surface disposed in the printing zone for supporting the record sheets to be printed, said support surface having a grooved recess and said at least one belt extending in the grooved recess over a portion of its run.

* * * * *